United States Patent [19]

Oliver

[11] 4,033,587

[45] July 5, 1977

[54] HORSE RACE BOARD GAME APPARATUS

[76] Inventor: Willie R. Oliver, 164 S. Portland Ave., Brooklyn, N.Y. 11217

[22] Filed: June 22, 1976

[21] Appl. No.: 698,768

[52] U.S. Cl. ..... 273/134 CH; 273/86 G; 273/134 CB

[51] Int. Cl.[2] ..... A63F 3/00

[58] Field of Search ..... 273/86, 134

[56] References Cited

UNITED STATES PATENTS

| | | | |
|---|---|---|---|
| 1,463,871 | 8/1923 | Chisolm | 273/86 A X |
| 3,883,143 | 5/1975 | Kelley | 273/134 CH |
| 3,985,357 | 10/1976 | Miller | 273/86 G |

FOREIGN PATENTS OR APPLICATIONS

| | | | |
|---|---|---|---|
| 566,777 | 11/1923 | France | 273/86 G |
| 2,439 | 3/1904 | United Kingdom | 273/134 CH |
| 162,129 | 4/1921 | United Kingdom | 273/86 G |

*Primary Examiner*—Delbert B. Lowe
*Attorney, Agent, or Firm*—Robert D. Farkas

[57] ABSTRACT

A horse race game apparatus comprises a game board having a horseshoe shaped racetrack on the playing surface. The racetrack is divided into a plurality of lanes, each lane having a plurality of spaces. Each lane includes track structure for guiding a horse-like marker around the lane elements, attached to the markers comprising a member coupled to the track structure and first and second elements coupled to the member and to each other for pulling the marker around the track in either direction a number of spaces according to the move dictated by the results of playing cards. A score card and chips are included.

8 Claims, 4 Drawing Figures

Fig. 1
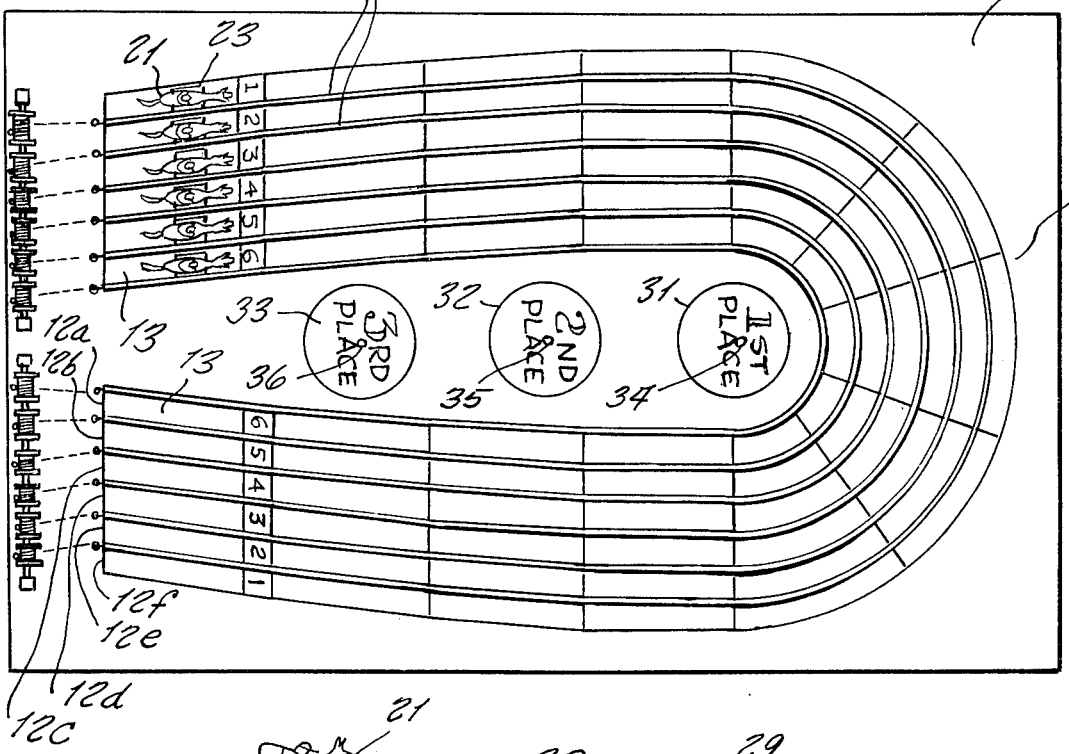
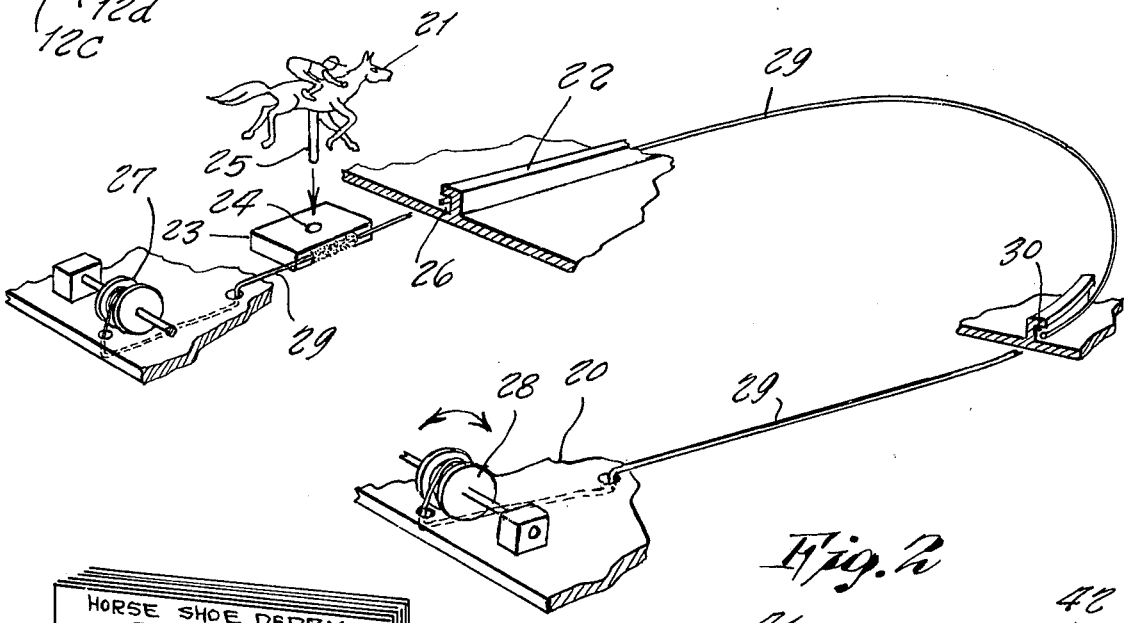
Fig. 2
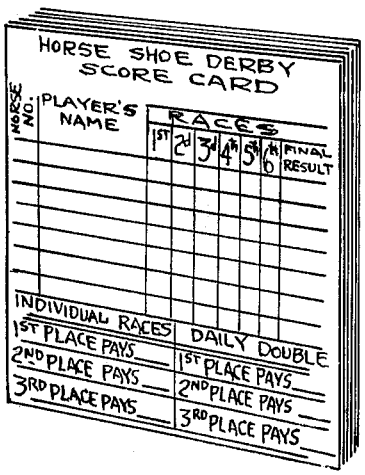
Fig. 3
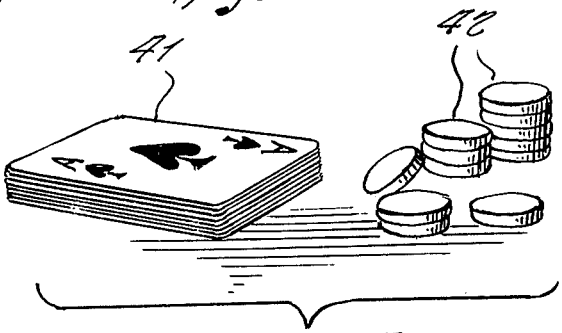
Fig. 4

HORSE RACE BOARD GAME APPARATUS

BACKGROUND OF THE INVENTION

This invention relates to a board game apparatus, and more particularly to a board game of the horse racing type having a horseshoe race track layout thereon.

The game apparatus comprises, in combination, a plurality of markers, a game board having a plurality of adjacent horseshoe shaped courses or lanes indicated thereon, 1st, 2nd and 3rd place indicia thereon, and score cards. The game is placed according to certain rules and as determined by the playing cards of each player.

An object of the invention is to provide a race game having a novel race board and which can be played so as to approach actual betting conditions.

SUMMARY OF THE INVENTION

A game apparatus comprises in combination, playing cards, score sheets and a game board, said game board having outlined thereon a horseshoe shaped racetrack divided into a plurality of adjacent lanes, each lane being divided into a plurality of spaces and having track guide means for guiding a horse-like marker around the lane, and means to which said markers are removably attached comprising a member coupled to said track means and first and second pulling means coupled to said member and to each other for alternatively pulling said marker around said track in either direction.

BRIEF DESCRIPTION OF THE DRAWINGS

FIG. 1 is a plan view of the game board showing the track layout;

FIG. 2 illustrates a simple mechanical means for advancing the horse marker;

FIG. 3 illustrates an embodiment of a score card; and

FIG. 4 illustrates playing cards and betting chips.

DETAILED DESCRIPTION OF THE INVENTION

Referring to FIG. 1, there is shown the game board 10 which may be constructed of wood, cardboard, metal, composition board or any other suitable material. It is obvious that the board may be of any size or shape and decorated in any suitable manner.

Stamped, printed or otherwise applied to the face of the board 10 is a horseshaped racetrack 11 having a plurality of adjacent lanes **12*a*, 12*b*, each lane being divided into a plurality of spaces 13, all lanes having the same number of spaces 13. The number of lanes determines the maximum number of players which can participate in the game at one time. It is obvious that while six lanes are shown in the figures the game can be made with a greater number or a smaller number of lanes. Similarly, while the figures show 13 spaces 13 per lane 12, the lanes can be divided into a greater or a lesser number of spaces 13. The number of spaces 13 in a lane 12** determines the total number of moves a player must make from the start of the race to the finish. The race can be run in either direction of the horseshoe, that is, from left to right or from right to left.

Also shown in FIG. 1 and more clearly in FIG. 2 is a reversible pulling means 29 for reversibly pulling a horse shaped marker 21 around each lane of the racetrack. The same number of pulling means 29 and markers 21 are provided as there are lanes 12. The lanes are consecutively numbered from lane number one through, as here depicted, lane member six and each marker 21 is preferably correspondingly numbered and will move in the respectively correspondingly numbered lane. The pulling means as shown in FIG. 2 comprises an inverted L-shaped track 22 along the side of each lane 12, for guiding the markers 21 along the lanes 12, a marker support member 23 having means to rotatably support the marker 21. As shown here, the member 23 is provided with a hole 24 into which a dowel 25 which extends downwardly from the belly of the horse shaped marker 21 may be inserted. With the marker 21 being supported facing in one direction it may be advanced in a forward direction when the race is run from the left side of the horseshoe to the right side of the horseshoe. It then is rotated 180° at the end of the race, and the next succeeding race can be run in the opposite direction. The member 23 is of a thickness so as to slideably fit in the space 26 formed between the track 22 and the board 10. The member 23 and hence the marker 21 supported by it are moved along the track by reversible mechanical means. These means comprise a pair of winches 27 and 28 associated with each lane 12, one winch 27 mounted in front of the first space 13 of the left side of the lanes 12 and one winch 28 mounted in front of the first space of the right side of the lanes 12. A cord 29 is provided which extends between and is coupled to both winches 27 and 28 of each pair and which is attached to the edge of the member 23 which rides in the track 22. The member 23 is attached to the cord 29 at a point where the member 23 can start at the first space of a lane and the length of cord 29 must be sufficient so as to pull the member 23 along the track 22 from one end of the lane to the other. When the race is run from left to right, generally most of the cord in initially wound on the left hand winch 27 and rotation of the right hand winch 28 which winds the cord onto this winch 28 causes the member 23 and marker 21 to move along the lane 12. To reduce wear of the cord 29 it is preferred that the track 22 be provided with a groove 30 in which the cord 29 will ride and which groove 30 has a low friction surface. The board is also provided with indicia 31, 32 and 33 in the central area of the horseshoe racetrack which indicate 1st, 2nd and 3rd place winners, respectively. Within the area defined by each indicia 31–33 there is provided a hole 34–36, respectively, into which the 1st, 2nd and 3rd place winning markers may be placed as the race progresses and ends by removing the dowel 25 of the marker 21 from the member 23 and placing it in the respective hole in the indicia.

It should be understood that the particular means shown for reversibly moving the marker along the lane is just one possible embodiment and other embodiments which perform the same function are part of this invention. For example, the embodiment shown may be embellished by providing the winches with electric motors driven by small batteries and activated with small switches mounted on the board. Alternatively, the track could be in the form of a large groove extending around the lane which an extension of the marker support member, which may be a wheel or a key, fits in the groove so as to roll or slide therein.

FIG. 3 illustrates a typical score card provided with the game. The score card provides columns for entering the horse number, the namme of the player corresponding to that number, the position each player finishes each of the races to be run, the computation of the final results according to the rules of the game and the pay-off for the 1st, 2nd and 3rd place positions for both the individual races and the daily double.

FIG. 4 simply illustrates a deck of common playing cards 41 and chips 42 included in the game.

The game is played, for example, by the dealer giving each player seven cards face down. The markers of each player are placed at the starting spaces of the respective lanes. Each player then turns his first card face up and the player having the highest card will advance his marker. In the event of a tie, one could either advance all of the tying players' markers or use the extra card in the deck for breaking the tie. The extra cards should be used for breaking any tie at the end of the game. The number of spaces to be moved by the winning player of each match of the cards may be the face value of the card or, if the players desire, be some lesser value depending upon the face value. For example, if the winning card is from 2–6, the player advances one space; if it is between 7–10, the player advances two spaces, and if it is a picture card the player advances three spaces. The cards from the first match are set aside after the winner of that match advances his marker and then the next set of cards are turned face up and so on. The race is not over until 1st, 2nd and 3rd place winners are determined. As each winner is determined his marker is placed in the appropriate indicia or winners' circle on the board. The winner of the game shall be the person having the highest final result score which will be calculated from the cumulative results of each race based upon the amount of money in the 1st, 2nd and 3rd place pots in each race. The amount placed in each pot is determined by the players before each race. The amount placed in the 1st place pot is greater than that of the 2nd place pot, and so on. Each player contributes to each pot. The amount of chips in the daily double pots should likewise be greater than the amount in the individual pots and is determined by the players. In the individual races the dealer reshuffles the cards at the end of each seven card hand. If the situation arises where there are insufficient cards to determine the winners the dealer will reshuffle the deck for a high card playoff.

What is claimed is:

1. A game apparatus comprising in combination playing cards, scoring means and a game board, said game board having outlined thereon a horseshoe racetrack divided into a plurality of adjacent lanes, each lane being divided into a plurality of spaces and having guide means for guiding a marker along the lane, and means on which said marker is removably supported, said means comprising a marker support member coupled to said guide means and first and second pulling means coupled to said member and to each other for alternatively pulling said marker along said track in opposite directions.

2. The game apparatus described in claim 1, wherein said scoring means consist of a sheet having columns for designating the marker number, the player's name corresponding to each marker, the results of each race run, the final results and the pay-off for the win, place and show positions.

3. The apparatus described in claim 2 including chips.

4. The apparatus described in claim 1, wherein each marker is in the form of a horse and jockey.

5. The apparatus described in claim 4, wherein each marker includes a dowel extending downwardly from the underside of said marker, said dowel fitting in a hole provided in each marker support member.

6. The apparatus described in claim 5 including 1st, 2nd and 3rd place indicia on said game board, each of said indicia having a hole therein into which said marker dowel fits.

7. The apparatus described in claim 1, wherein said guide means comprises a track with which said marker support member is coupled and wherein said first and second pulling means comprises a pair of winches coupled to each other by means of a cord which extends from one winch around said track to the second winch, said cord being attached to said member.

8. The apparatus described in claim 7, including a cord groove in said track.

* * * * *